United States Patent [19]

Desjarlais

[11] 4,307,170

[45] Dec. 22, 1981

[54] NEGATIVE-WORKING DIAZO TYPE PHOTOREPRODUCTION HAVING IMPROVED PH CONTROL

[75] Inventor: Robert C. Desjarlais, South Hadley, Mass.

[73] Assignee: James River Graphics, Inc., South Hadley, Mass.

[21] Appl. No.: 160,649

[22] Filed: Jun. 18, 1980

[51] Int. Cl.[3] ..... G03C 1/52

[52] U.S. Cl. ..... 430/147; 430/174; 430/180; 430/181; 430/179

[58] Field of Search ..... 430/179, 147, 177, 196, 430/171, 180, 181, 182, 191, 196, 174

[56] References Cited

U.S. PATENT DOCUMENTS 3,420,665 1/1969 Bialczak ..... 430/179

*Primary Examiner*—Won H. Louie, Jr.

*Attorney, Agent, or Firm*—Burns, Doane, Swecker & Mathis

[57] ABSTRACT

Negative-working diazography formulation is comprised of (i) at least one hexafluorophosphate diazonium salt adapted to photolytically cleave into an acid catalyst, (ii) at least one acid labile enolic, preferably arylenolic blocked-coupler adapted to be converted in the presence of acid to an active azo-coupling component, and (iii) an effective amount of an additive, such as p-toluenesulfonyl benzamide, capable of controlling the pH of films prepared from said formulation when subjected to a clearing step as defined herein.

26 Claims, No Drawings

NEGATIVE-WORKING DIAZO TYPE PHOTOREPRODUCTION HAVING IMPROVED PH CONTROL

BACKGROUND OF THE INVENTION

1. Field of the Invention

The present invention relates to negative-working diazotype photoreproduction and, more especially, relates to a negative-working diazotype photoreproduction system adapted to utilize conventional diazonium salts in combination with a blocked-coupler which is activated by acid.

2. Description of the Prior Art

Diazotype photoreproduction is of course a standard in the graphic arts. The touchstone of the diazography processes is the light-sensitivity of aromatic diazo salts and the fact that such salts undergo two different types of reactions: [1] replacement or decomposition, in which nitrogen is lost or evolves as nitrogen gas and some other atom or group attaches to the benzene ring in its stead; and [2] "coupling", wherein the nitrogen of the daizo function is retained and the salts react with certain couplable color-forming components, i.e., a "coupler" or "azo-coupling component", to effect formation of an azo dye species.

The photochemical sensitivity of the compounds typically employed in diazotype photographic reproduction ["photoreproduction"] materials resides in the near-ultraviolet region of the spectrum, and is centered about 400 nm [nanometers, one nm being equal to a millimicron or $10^{-9}$ meter]. Photographic diazo processes may be divided into two basic categories: positive-working processes and negative-working or reversal, processes. In the former category, the action of light causes photochemical decomposition of the diazo compound. An image is developed in the unexposed areas by the combination of the diazo compound with a "coupling" component, which is generally an aromatic amine, phenol, or aliphatic compound containing active methylene groups, to form colored oxyazo or aminoazo compounds known as azo dyes.

The positive-working material is imaged by first exposing it through a master transparency or original. The light in the exposure step must supply sufficient energy to destroy the diazo compound in the areas corresponding to the clear background of the original. High-pressure mercury vapor lamps are generally used in performing this step. That part of the diazo coating which is unprotected from the ultraviolet radiation by the image on the original becomes a colorless substance, incapable of coupling to form a dye. The unaffected diazo compound which remains in those areas where the light has not struck is able to form an azo dye by reaction with a coupling component when the medium is made alkaline. Thus, wherever there was an opaque line on the original, a dye-line appears on the copy. Positive-working, diazotype photoreproduction material is generally made alkaline, or pH adjusted, either by impregnating the material with ammonia vapors or passing it through an alkaline developing solution. See generally U.S. Pat. Nos. 1,444,469; 1,628,279; 2,217,189; 2,286,701; 2,429,249; and 2,694,009; German Patentschriften Nos. 56,606; 111,416; 487,247; and 515,205; British Patent Specification Nos. 234,818; 281,604; and 521,492.

In the negative-working or reversal process, a dye is formed in the exposed areas, but not in the areas protected from light. See U.S. Pat. Nos. 2,034,508 and 2,095,408; German Patentschriften Nos. 53,455 and 82,239. Thus a negative, or reversed, copy of the original transparency results. Among the processes employing diazo compounds to produce reversal copies and those employing diazosulfonates. Illustrative thereof is U.S. Pat. No. 2,854,338 to Herrick et al, wherein a neutral or acid photosensitive material is exposed to actinic light and developed in ammonia vapors. Residual diazosulfonate is removed from the unexposed areas and the background cleared by washing in water. In accordance with a more recent process, disclosed in U.S. Pat. No. 3,479,183 to Habib et al, an alkaline imaging material is exposed to actinic illumination to convert the diazosulfonate to an active diazonium compound which combines with a coupling component to provide a reverse dye-image. Since the generation of the imaging diazonium is thus accomplished principally by the incident radiation, powerful light sources must be used for exposing the diazotype material. After imaging, the material is acidified and the unreacted diazosulfonate is light-cleared by exposing it to overall actinic illumination, thereby forming colorless decomposition products of the diazosulfonate to produce a stable, negative dye-image against a clear background. Cf. the U.S. Pat. No. 3,713,825 to Girard; U.S. Pat. No. 1,926,322 to Van der Grinten.

Another negative-working process which utilizes diazo compounds to produce azo dye images is the diazo-oxide mode of photoreproduction.

The basic operating differences between the diazosulfonate and diazo-oxide reversal processes are as follows, reference being made to "Decomposition of o-Hydroxy-Diazonium Compounds by Light," J. DeJonge and R. Dijkstra, Recueil, 67, (1948) pp. 328–342:

[1] The irradiation product of o-hydroxy benzene diazonium compound is a cyclopentadiene carboxylic acid while the irradiation product of benzene diazosulfonate is the structurally isomeric diazo compound itself. As a result of the light decomposition, the practical and significant difference between the negative diazosulfonate process and the diazo-oxide reversal process is the fact that a wide variety of azo dye colors may be produced from diazosulfonate coupler combinations whereas only one azo dye may be produced from each diazo-oxide. The cyclopentadiene-carboxylic acid decomposition product couples much more rapidly than phenolic, naphthol or pyrazalone couplers [see page 335, paragraph 2 of the aforementioned article].

[2] The cyclopentadiene carboxylic acid formed as a result of decomposition under actinic light is a very active coupling component and forms red azo dyes with the diazonium compound.

[3] The fixing or prevention of image formation in the unexposed portions of diazo-oxide coated support requires that there be complete elimination of moisture or adjustment of the coated support to extremely high acid levels. This requirement need not be met with certain of the diazosulfonates.

Nonetheless, it too is well known to this art that negative-working diazography based on either diazosulfonate or diazo-oxide chemistry leaves much to be desired in terms of product imaging characteristics, namely, the diazosulfonate films required long exposure times to effect isomerization of the noncoupling trans-isomer to the reactive cis-form needed to provide an azo dye image. Additionally, the need for impractically lengthy fixing exposures likely shall continue to militate against widespread use of this approach. Insofar as the diazo-oxide based films are concerned, same, in effect, generate coupler in situ through partial decomposition of the diazo moiety. The film is cleared by post-development exposure to destroy background diazo. The diazo-oxide films are also apparently quite limited in density and re-exposure schemes for enhancing image density by several successive re-exposure/cycles have been proposed. Cf. U.S. Pat. No. 4,108,664 to deBoer et al; U.S. Pat. No. 4,094,681 to Habib et al.

Yet another negative-working system features a "vesicular" film which is exposed to actinic radiation to form a latent nitrogen gas image therein from a preselected master image. The nitrogen gas evolves upon the light decomposition of the diazonium salt, and upon storage, the nitrogen would slowly diffuse out of the film. However, upon heating, the nitrogen expands and forms small visible bubbles or vesicles in the film. Thus, vesicular imaging is, in reality, a foaming process of sorts; same is essentially confined to single-component systems applicable to projection imaging, or microfiche/reader uses. Compare, for example, the U.S. Pat. Nos. 3,149,971; 3,555,295; 3,779,768; 3,779,774; 3,841,874; and 3,979,211.

In the U.S. Pat. No. 4,055,425 to Mustacchi, a diazotype material is described comprising a light-sensitive, water-insoluble diazoamino compound, an azo coupler, and an alkaline material, said diazoamino compound, when exposed to ultraviolet light, being reactive with said azo coupler to form a visible dye product only at a pH greater than 7. Such diazotype material can be used for diazotype reproduction processes resulting in either negative or direct positive images. Such material necessitates use of rather exotic equipment and, in the negative-working mode, treatment with an external acid source is mandated, and can be corrosive to the equipment. In addition, the processing entails an extra step in the photoreproduction sequence.

"Thermal" processes are also common to the art; U.S. Pat. Nos. 3,303,028; 3,499,760; 3,695,885; and 3,889,335.

Compare also the negative-working variant disclosed in the U.S. Pat. No. 3,765,895 to Fox wherein free-radical precursors are activated by photodecomposition of a diazonium salt. This patent features the ability of diazoniums to yield a free-radical by homolytic cleavage of the C-N bond, does not entail the formation of azo dyes or ammonia development, and, indeed, such process is operable even in the absence of diazo salt.

Other variations on the theme are suggested by, e.g., U.S. Pat. Nos. 1,857,920, 2,095,408, 2,381,984, 2,416,021, 2,516,931, 2,976,145, 3,140,180, 3,307,952, 3,331,689, 3,563,744, 3,620,740, 3,769,018 and 3,793,033; British Patent Specification No. 975,457.

In view of the above noted technology and in response to the need to develop a simple negative-working diazography process a number of formulations were discovered which are disclosed in U.S. Patent Application Ser. No. 66,401, of E. W. Bennett, filed on Aug. 14, 1979, now U.S. Pat. No. 4,252,884, the disclosure of which is herein incorporated by reference.

The primary components of this formulation comprise (1) at least one diazonium compound, (2) an inactive blocked-coupler and (3) a specifically defined photolabile, or light-sensitive acid progenitor.

In a preferred embodiment, the diazo compound and light-sensitive acid progenitor constitute the same compound. This is achieved when the diazonium compound is a diazo salt comprising a complex anion of an inorganic Lewis acid. Thus, in this embodiment the diazonium compound functions as either a reactant source for the formation of an azo dye species upon reaction with an activated coupler, or as an acid generating compound wherein a controlled amount of light decomposes the diazonium salt thereby releasing nitrogen and a Lewis acid.

The above described formulation is employed in a negative-working imaging process wherein the formulation is typically provided in the configuration of a film. The film is subjected to an imagewise exposure of light in a manner sufficient to generate catalytic amounts of acid from, for example, the photolabile diazonium salt. Preferably aided by heating, the liberated acid reacts with the inactive blocked-coupling agent to unblock its functional group, and impart to the unblocked coupler the potential to react with the diazonium salt. The reaction between the diazonium salt and the coupling agent is induced in a developing stage wherein the film is subjected to an alkaline environment, preferably, at elevated temperatures, to form the azo dye.

The unreacted diazonium compound is preferably decomposed in a clearing step by exposing the developed film to actinic light, e.g., for about 60 seconds.

While the above processes and formulations employed therein have many advantages over the prior art certain difficulties have been observed. For example, when films employing certain of such formulations are cleared by overall exposure to light the color of certain of the azo dyes is often changed in a drastic fashion. Thus, yellows become purple, sepias become blue and so forth.

Furthermore, often within a few days after the finished print is obtained the transparency of the image in the minimum density areas thereof is reduced substantially. This loss in transparency is commonly observed when a hexafluorophosphate diazonium salt is employed in the diazography formulation in conjunction with a clearing step by overall exposure to light. More specifically, it has been observed that large amounts of acid are liberated from the diazonium salt during the clearing step. The acid environment created threby adversely affects the color of acid sensitive dyes. This is referred to as acid discloration.

The cause of the loss in transparency of the image over a period of several days from the time when the print is obtained has, it is believed, heretofore been unknown. However, after considerable experimentation it has been discovered that the loss in transparency is believed to be due to the formation of ammonium dihydrogen phosphate bloom which forms as a result of the reaction between acid liberated during the clearing step and the ammonia remaining in the film after the developing stage which employs moist ammonia vapors.

Thus, it would be a distinct advantage if the acid liberated during the clearing step could be scavenged before acid discoloration occurs and if the bloom, i.e., formation of ammonium dihydrogen phosphate, could be substantially reduced or eliminated.

The selection of an appropriate acid scavenger is complicated by the fact that it must be substantially inactive during the imaging step otherwise the acid liberated thereby would be inactivated, and the unblocking of the blocked-coupler by acid cleavage would thereby be reduced substantially. In addition to the above requirements, an acceptable additive should be preferably insensitive to moisture, colorless, compatible with the film matrix material, and soluble in ketone and alcohol solvents.

Thus, the search has therefore continued for ways to improve the image and color stability of certain diazography formulations. The present invention was developed as a result of this search.

Accordingly, it is an object of the present invention to improve the acid color stability of certain negative-working diazography formulations described herein which are subjected to a clearing step.

It is a further object of the present invention to improve the image stability of certain diazography formulations described herein which are subjected to a clearing step.

These and other objects and features of the invention will become apparent from the claims and from the following description when read in conjunction with the accompanying drawings.

SUMMARY OF THE INVENTION

In one aspect of the present invention there is provided a light-sensitive diazography formulation, comprising (i) at least one light-sensitive hexafluorophosphate salt of a diazonium compound adapted to photolytically cleave into a acid catalyst, (ii) at least one acid labile enolic, preferably arylenolic blocked-coupler adapted to be converted in the presence of acid to an active azo-coupling species and (iii) an effective amount of at least one additive represented by the structural formula:

$$R-SO_2-NH-\overset{\overset{\displaystyle O}{\|}}{C}-R'$$

wherein R is selected from the group consisting of aryl of from about 6 to 10 carbons, alkyl of from about 1 to about 12 carbons, aralkyl wherein aryl is from 6 to about 10 carbons and the alkyl is from about 1 to about 5 carbons; R′ is selected from the group consisting hydrogen, alkyl of from about 1 to about 12 carbons, aryl of from 6 to about 10 carbons, alkoxy of from about 1 to about 12 carbons, alkylthiomethyl of from about 1 to about 12 carbons, alkoxymethyl of from about 1 to about 5 carbons, trifluoroalkyl of from about 1 to about 3 carbons, aralkyl wherein the aryl thereof has from 6 to about 10 carbons and the alkyl thereof has from about 1 to about 5 carbons, amino, and alkyl substituted amino of from about 1 to about 5 carbons, said effective amount being sufficient to reduce acid discoloration and bloom.

In another aspect of the present invention there is provided a light-sensitive diazotype-photoreproduction material, comprising a support member coated with the diazography formulation described above.

In a further aspect of the present invention there is provided a negative-working diazography photoreproduction process, comprising imagewise exposing the above described diazotype material to light of a quality and quantity sufficient to photochemically liberate catalytic amounts of acid therefrom, thus unblocking coupler molecules, developing said diazotype material under alkaline conditions such that active azo-coupling species couple with undecomposed diazonium compound in the light-struck areas to form azo dye, and thence decomposing the unreacted diazonium salt by exposure to actinic light.

DESCRIPTION OF THE PREFERRED EMBODIMENTS

In accordance with the present invention certain additives are incorporated into a light-sensitive diazotype reproduction formulation of the type disclosed in the above described U.S. Patent Application Ser. No. 66,401 which comprises (i) at least one complex, light-sensitive hexafluorophosphate salt of a diazonium compound adapted to photolytically cleave to yield an acid species (ia) and a diazonium salt (ib), (ii) a particular enolic, preferably arylenolic, e.g., phenolic or naphthaloic, blocked-coupler, or precursor of an azo-coupling component adapted to be converted in the presence of the acid species (ia) into an active azo-coupling component.

The above-described formulation containing the additives described hereinafter is employed in a process which comprises (1) the imagewise exposure of the aforenoted diazography formulation to irradiation, e.g., actinic light, of a quality and quantity sufficient to generate catalytic amounts of acid from the photolabile diazonium salt, said catalytic amounts being sufficient to effect conversion of the inactive precursor or azo-coupling component into an active azo-coupling component, (2) subjecting the thus exposed diazotype material to an alkaline developing environment, thereby enabling the active azo-coupling component formed in the light-struck areas to couple with the diazonium compound to form an azo dye and (3) clearing, i.e., decomposing the unreacted diazoniumm salt by exposure to actinic light.

The imagewise exposure to light is typically conducted by subjecting the diazography formulation to light, typically in the UV or blue region of the spectrum for a period of from about 8 to about 12 seconds. With certain formulations, however, exposure times of 3 seconds or less are fully operative.

The developing step is typically conducted by exposure of the imaged formulation to a weak moist ammonia atmosphere.

In a preferred embodiment of this process, the imaging or light exposure step is followed by a heating step, e.g., exposure to a temperature of from about 100° to about 210° F., preferably from about 120° to about 200° F. (e.g. 160° to about 190° F.) for a period of about 5 to about 15 seconds, preferably from about 7 to about 10 seconds (e.g., 8 seconds) to enhance the intensity of the image which is ultimately obtained. The development chamber containing the moist ammonia atmosphere is also preferably heated to similar temperatures.

The clearing step, is conducted by exposing the developed diazography formulation to overall actinic light for a period sufficient to decompose unreacted diazonium salt in the background areas of the image. Generally, clearing exposure times will vary from about 40 to about 80 seconds (e.g., 60 seconds).

In order to fully appreciate the role performed by the additives described hereinafter, when incorporated into the diazography formulation it is beneficial to examine the mechanisms believed to operate in the formation of the final print.

The underlying principles set forth in the above-described U.S. Pat. Application Ser. No. 66,401, by which the diazography formulation operates is believed to involve the release of acid from the diazonium salt in response to exposure to light and the subsequent removal of the blocking group from the coupler molecule by acid cleavage thereof. Consequently, when the film is developed, the unblocked-coupler reacts with the remainder of the diazonium salt to form the diazo dye image only in the light-struck areas. Thus, the more intense the light in a particular area of film the darker will be the image because more of the acid will be released.

The acid release mechanism is illustrated by the following sequence:

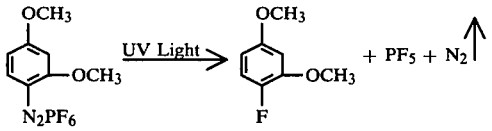

The resulting $PF_5$ complexes with a blocked-coupler in accordance with the following illustrative reaction sequence:

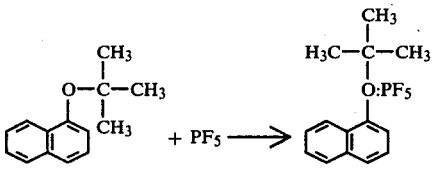

Blocked Coupler Complex

While not wishing to be bound to or by any particular theory or mechanism of reaction, it is likely that the photochemically induced removal of the blocking group from the enolic or arylenolic oxygen of the coupler molecule, resulting in the formation of dye image only in the lightstruck areas, can proceed either by intramolecular rearrangement of the coupler molecule, or via the acid cleavage thereof.

For example, the $PF_5$ complex ultimately undergoes intramolecular rearrangement to form the actual coupler species:

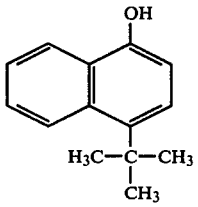

and/or acid cleavage thereof into the likewise active coupler species:

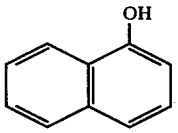

Some of the acid cleavage which results in unblocking of the coupler may also be caused by acid species which are derived by hydrolysis of the $PF_5$ with the water present in a humid environment. For example, the $PF_5$ may hydrolyze to form the following acid species:

$$PF_5 \xrightarrow{4H_2O} 5HF + H_3PO_4$$

or $$PF_5 \xrightarrow{H_2O} POF_3 + 2HF$$

$$POF_3 \xrightarrow{3H_2O} 3HF + H_3PO_4$$

In the developing or fixing stage the aqueous alkaline environment permits the unblocked coupler to react with the remaining diazonium salt in accordance with the following representative sequence:

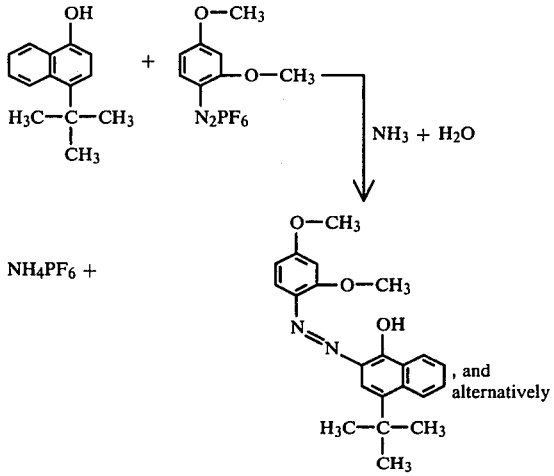

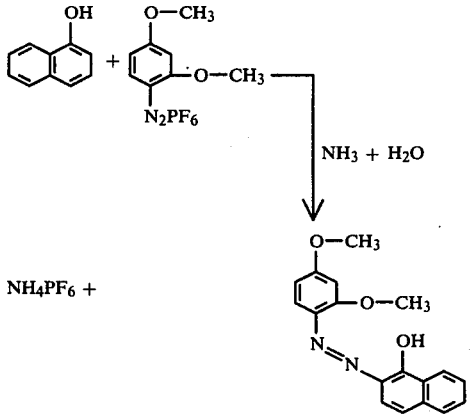

Obviously, other than para-position intramolecular rearrangement is possible, and other isomeric dye forms too are envisaged.

When the diazography formulation is subsequently subjected to the clearing step $PF_5$ is again released. It has been found that some of the $PF_5$ released reacts with residual ammonia and water left over from the developing step in accordance with the following reaction sequence:

$$PF_5 + NH_3 \rightarrow PF_5{:}NH_3$$

$$PF_5{:}NH_3 + 4H_2O \rightarrow NH_4H_2PO_4 + 5HF$$

The resulting ammonium dihydrogen phosphate is incompatible with the film matrix and is believed to eventually migrate or bloom to the surface of the film thereby causing a loss of transparency in the final image. The $PF_5$ acid and hydrolysis products thereof which do not react with ammonia as well as the hydrofluoric acid which is formed simultaneously with the ammonium dihydrogen phosphate creates an acid environment which alters the color of acid sensitive dyes in an undesirable manner.

Thus, control of the pH of the formulation during and after the clearing step is essential toward reducing bloom and discoloration.

The appropriate pH control is achieved by incorporating additives which are represented by the following generic formula:

$$R-SO_2-NH-\overset{\overset{\displaystyle O}{\|}}{C}-R' \qquad [I]$$

wherein R can represent aryl of from about 6 to about 10, preferably about 6 carbons, alkyl of from about 1 to about 12, preferably from about 1 to about 5 carbons, aralkyl wherein the aryl and alkyl are as above defined, and trifluoroalkyl of from about 1 to about 3 carbons, preferably from about 1 to about 2 carbons; R′ can represent hydrogen, alkyl of from about 1 to about 12, preferably from about 1 to about 5 carbons, aryl of from 6 to about 10, preferably about 6 carbons, alkoxy, alkylthiomethyl, alkoxymethyl, and trifluoroalkyl wherein the alkyl group is as defined above, aralkyl wherein the aryl and alkyl is as defined above, amino, and alkyl substituted amino wherein the alkyl is as above defined. Mixtures of any of the above described compounds can also be employed.

The preferred additives are those represented by structural formula [I] wherein R′ is methyl or phenyl, and R is aryl or alkaryl.

Representative examples of suitable R, R′ groups which can be associated together in an individual compound include the following.

| R | R′ |
|---|---|
| $-CH_3$ | $-CH_3$ |
| 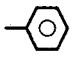 | 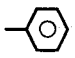 $-CH_3$ |
| 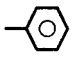 $-CH_3$ | 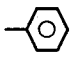 $-CH_3$ |
| 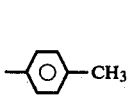 $-CH_3$ | 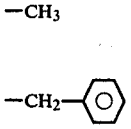 |
| 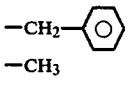 | 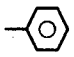 $-CH_3$ |
| $-CH_2-$ $-CH_3$ | $-CH_2-$ 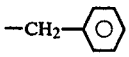 |
| $-CH_3$ | $-\overset{\overset{\displaystyle CH_3}{\|}}{\underset{\underset{\displaystyle CH_3}{\|}}{C}}-CH_3$ |
| $-CH_3$ | $-OCH_3$ |

-continued

| R | R′ |
|---|---|
| $-CH_2-$ 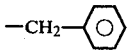 | $-OCH_3$ |
| 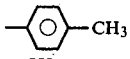 $-CH_3$ | $-OCH_3$ |
| $-CH_3$ | $-CF_3$ |
| $-CH_3$ | $-H$ |
| 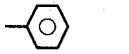 | $-CH_2-O-CH_2-CH_3$ |
| $-CH_2-$ 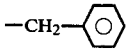 | $-CH_2-S-CH_2-CH_3$ |
| $-CH_3$ | $-NH_2$ |
| $-CH_3$ | $-N(CH_3)_2$ |

Representative examples of preferred additives include the following compounds:

(1) p-Toluenesulfonylacetamide
(2) p-Toluenesulfonylformamide
(3) p-Toluenesulfonylbenzamide
(4) p-Toluenesulfonylpivalamide
(5) p-Toluenesulfonyltrifluoroacetamide
(6) p-Toluenesulfonylmethylcarbamate
(7) p-Toluenesulfonylphenylacetamide
(8) p-Toluenesulfonylurea
(9) Methanesulfonylacetamide The most preferred additives include p-toluenesulfonylbenzamide, and p-toluenesulfonylacetamide.

The above-described additives are insensitive to water but react with residual ammonia left over from the developing stage to form an ammonium salt. The ammonium ion of these salts then reacts with the acid products (e.g., $PF_5$, HF, $POF_3$) generated by the light clearing step to form salts which are compatible with the film matrix.

A representative reaction sequence is illustrated by the following:

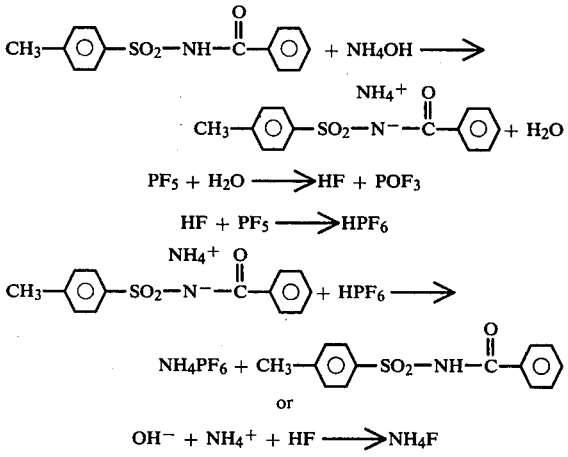

Both the $NH_4PF_6$ and $NH_4F$ salts are compatible with the film matrix.

Thus, the additive is incapable of reacting with acid during the imaging step and consequently does not inhibit the unblocking of the coupler which is necessary for the formation of the azo dye. However, once the requisite degree of unblocking has occured the additive is converted to an acid scavenger by reaction with excess ammonia during and after the developing stage.

The resultant ammonium salt provides the necessary pH control during and after the clearing step by preventing the pH of the film from dropping to the extent that the color of acid sensitive dyes which have formed is adversely affected. Furthermore, as described above, the additives substantially reduce or eliminate the formation of the ammonium dihydrogen phosphate salt which is incompatible with the film matrix and which blooms to the surface thereof reducing the transparency of the film, and cause the formation instead of matrix compatible salts which do not affect the transparency of the film.

In addition, to the above-described advantages the additives are colorless and soluble in ketone and alcohol solvents.

While any effective amount of the above-described additive may be employed in the diazography formulation, it is preferred that such effective amount be sufficient to achieve a molar ratio of additive to diazonium salt of from about 2:1 to about 1:2, preferably from about 1.5:1 to about 1:1.5 and most preferably from about 1.2:1 to about 1:1.2 (e.g., 1:1). Effective amounts are characterized by the ability to reduce bloom, and acid discoloration to an extent greater than would otherwise occur in the absence of said additives.

The Blocked-Couplers

The blocked-couplers which may be employed in the diazography formulation of the present invention contain enolic, preferably, arylenolic, e.g., phenolic or naphtholic groups which are blocked through an acid sensitive or labile oxygen bridge to a "blocking" moiety. Suitable blocked-couplers include those described in commonly assigned U.S. Patent Application Ser. No. 66,401 filed on Aug. 14, 1979 the disclosure of which is herein incorporated by reference.

Such blocked-couplers are incapable of reacting with any diazonium salt present to effect formation of an azo dye up and until such time as acid catalysis has unblocked the active enolic coupler species.

The preferred arylenolic blocked-couplers are of the genera: tertiary ethers, and the various acetal, ketal and MEM ether derivatives of phenols. The tertiary ether phenols comprise a tert-blocking group linked through an acid labile bond via an oxygen atom to an aryl coupler moiety and have the structural formula:

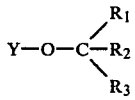

[II]

wherein each R, which may be the same or different but which cannot be hydrogen, is alkyl, preferably straight or branched chain lower alkyl of from 1 to 8 carbons; aryl, preferably aryl of from 6 to 10 carbons; cycloalkyl, preferably cycloalkyl of from 3 to 8 carbons; aralkyl and alkaryl, wherein alkyl, aryl are as above defined; and wherein Y is aryl, e.g., phenyl, naphthyl, and the like. Moreover, any two or three of said R substituents may be linked together to form a tert-cyclic, bicyclic or heterocyclic structure. Also, any one or more of the R and Y moieties may itself or themselves be substituted by any one or more substituents not atypical to diazo-type photoreproduction components, and which will not interfere with the acid catalyzed unblocking chemistry above described.

The acetal derivatives have the structural formula:

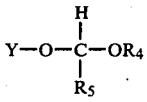

[III]

and the ketal derivatives, the structural formula:

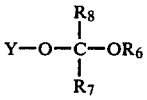

[IV]

wherein Y and each R, which also may be the same or different, are as above defined for formula [II], except that in the formula [III] the $R_5$ moiety, but not $R_4$, can also be hydrogen. Also as above defined, any two or three of said R substituents may be linked together to form a cyclic, bicyclic or heterocyclic structure. Similarly, the various Y and R moieties may be either substituted or unsubstituted.

Additionally, in the above formulae [II], [III] and [IV], any R and Y may be taken together to define a fused or polycyclic basic nucleus, e.g., naphthyl or diphenyl, and R may even be Y.

Also included are compounds of the type:

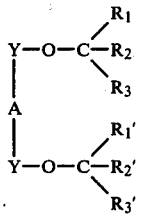

[V]

wherein each R is as above defined and A is any suitable bridging atom, group, e.g., alkylene, or direct chemical bond.

The MEM ether acetals are especially attractive and correspond to those having the structural formulae:

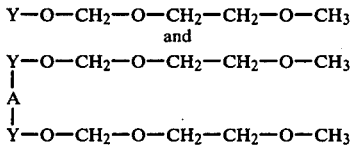

[VI]

and

[VII]

wherein Y and A are as above defined.

A further class of preferred blocked-couplers can be represented by the structural formula:

[VIII]

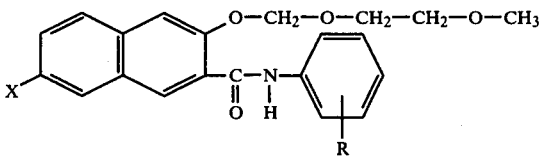

wherein X is selected from the group consisting of hydrogen, bromine, and methoxy, and R can represent alkyl, preferably lower alkyl of from about 1 to about 8, most preferably from about 2 to about 4 carbons; alkoxy wherein the alkyl group is as defined above; acyl; and halogen selected from the group consisting of chlorine, bromine, fluorine iodine.

Representative blocked-couplers thus include the following:

| Structure | Chemical Name |
|---|---|
| 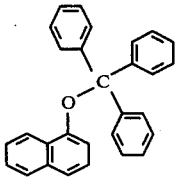 | 1-naphthyl-triphenyl-methyl ether |
| 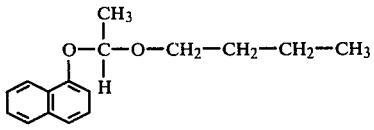 | 1-butoxy-1-(1-naphthoxy)ethane |
| 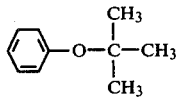 | t-butyl phenylether |
| 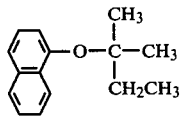 | 2-(1-naphthoxy)-2-methyl-butane |
| 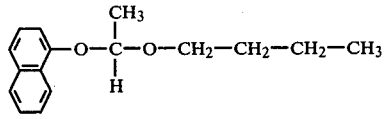 | 1-(1-butoxy)-1-naphthoxy)ethane |
| 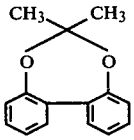 | Dibenzo(d,f)-2,2-dimethyl-1,3-dioxepine |
| 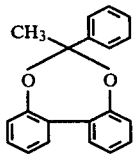 | Dibenzo(d,f)-2-methyl-2-phenyl-1,3-dioxepine |
| 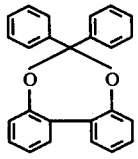 | Dibenzo(d,f)-2,2-diphenyl-1,3-dioxepine |
| 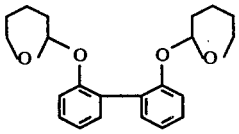 | 2,2[1]-di(2-tetrahydro-pyranoxy)diphenyl |
| 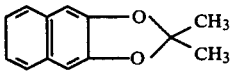 | 2,3-isopropylidene-dioxynaphthalene |
| 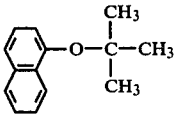 | t-butyl-1-naphthyl ether |
| 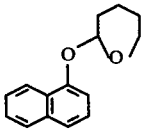 | 1-naphthyl-2-tetra-hydropyranyl ether |

-continued

| Structure | Chemical Name |
|---|---|
| 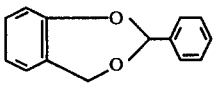 | Benzo(e)-2-phenyl-1,3-dioxin |
| 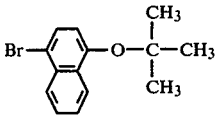 | t-butyl-(4-bromo-1-naphthyl) ether |
| 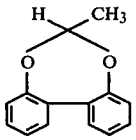 | Dibenzo(d,f)-2-methyl-1,3-dioxepine |
| 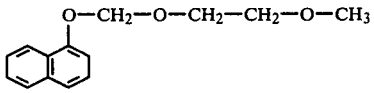 | β-methoxyethoxymethyl-α-naphthylether |
| 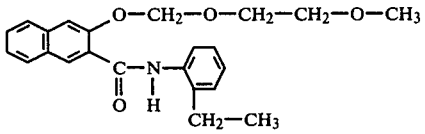 | 3-(methoxyethoxymethoxy)-N-(2-ethylphenyl)-2-naphthalamide |
| 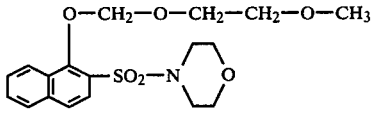 | 2-(morpholinosulfonyl)-1-(methoxyethoxymethyl)-naphthyl ether |
| 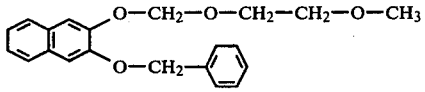 | 3-benzyloxy-2-(methoxyethoxymethyl)naphthyl ether |
| 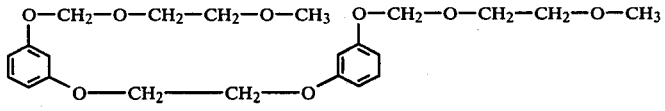 | Bis(3-methoxyethoxymethoxy-1-phenylene)ethylene diether |
| 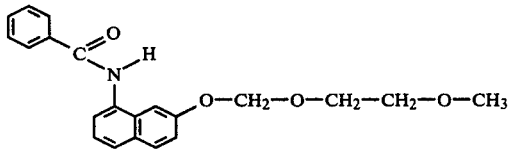 | (8-N-benzoylamino-2-(methoxyethoxymethyl)naphthyl ether |
| 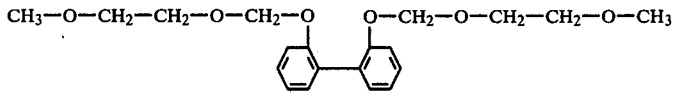 | 2,2'-methoxyethoxymethoxy biphenyl |
| 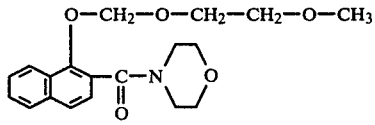 | 2-(morpholinocarbonyl)-1-(methoxyethoxymethyl)-naphthyl ether |
| 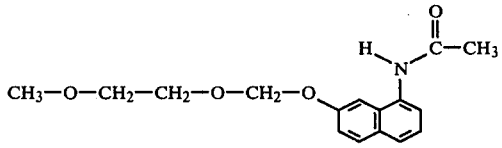 | 5-N-acetylamino-3-(methoxyethoxymethyl)-naphthyl ether |
| 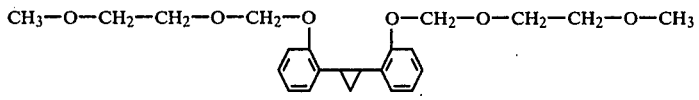 | 1,2-Bis(2,2'-methoxyethoxymethoxyphenyl)-cyclopropane |
| 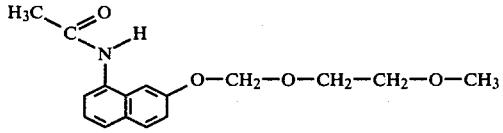 | 8-N-acetylamino-2(methoxyethoxymethyl)naphthyl ether |

-continued

| Structure | Chemical Name |
|---|---|
| 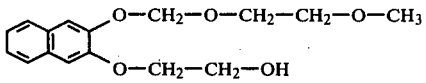 | 3-(2-hydroxyethoxy)-2-(methoxyethoxymethyl)-naphthy ether |

The Diazonium Salt

As described above, the acid for the unblocking reaction in the present invention is derived from a diazonium salt. Any of the known diazonium compounds capable of forming a positive image in a conventional diazo element are suitable for producing a negative image in the diazo formulation of the present invention and are therefore suitable for use as the source of the cation in the diazonium salt.

Illustrative of the aromatic diazonium cations comprising the photosensitive salts utilized in accordance with the present invention are the following:

(1) p-Chlorobenzenediazonium;
(2) 2,4-Dichlorobenzenediazonium;
(3) 2,5-Dichlorobenzenediazonium;
(4) 2,4,6-Trichlorobenzenediazonium;
(5) p-Methoxybenzenediazonium;
(6) O-Methoxybenzenediazonium;
(7) 4-Chloro-2,5-dimethyoxybenzenediazonium;
(8) 2,4,5-Triethoxy-4-biphenyldiazonium-(2,5-diethoxy-4-(p-ethoxyphenyl)benzenediazonium);
(9) 2,5-Dimethoxy-4'-methyl-4-biphenyldiazonium-(2,5-dimethoxy-4-(p-tolyl-benzenediazonium);
(10) 2,5-Diethoxy-4-(phenylthio)benzenediazonium;
(11) 2,5-Diethoxy-4-(p-tolylthio)benzenediazonium;

The anion of the diazonium salts which has been found to release an acid which is most suitably controlled by the additives described herein is hexafluorophosphate, $PF_6^-$.

The most preferred diazonium salts include those represented by the following generic structural formula:

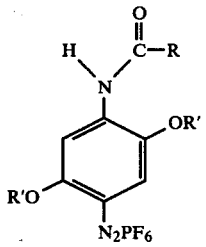

[IX]

wherein R can represent hydrogen, alkyl, preferably straight or branched chain lower alkyl of from 1 to about 10, most preferably from about 1 to about 3 carbons; aryl, preferably aryl of from 6 to about 10 carbons, most preferably 6 carbons; cycloalkyl, preferably cycloalkyl of from 3 to about 6 carbons, most preferably from about 4 to about 6 carbons; aralkyl and alkaryl, and wherein the alkyl, and aryl portions thereof are as defined above; alkoxy, preferably alkoxy of from about 1 to about 5 carbons, most preferably from about 1 to about 3 carbons; alkylthio, preferably alkylthio of from about 1 to about 5 carbons,most preferably from about 1 to about 3 carbons; alkoxymethyl, preferably alkoxymethyl of from about 1 to about 5 carbons, most preferably from about 1 to about 3 carbons; aryloxymethyl, preferably aryloxymethyl wherein the aryl group contains from about 6 to about 10 carbons, most preferably about 6 carbons; arylthiomethyl, preferably arylthiomethyl wherein the alyl group contains from about 6 to about 10 carbons, most preferably about 6 carbons; trifluoroalkyl wherein the alkyl is as described above; and furanyl; and R' which can be the same or different can represent alkyl aryl cycloalkyl, aralkyl as defined above in connection with R with the proviso that R' cannot be tertbutyl; hydroxyalkyl wherein the alkyl group contains at least 2 carbons, and preferably from 2 to about 5 carbons; methoxyalkyl wherein the alkyl group contains at least 2 carbons, preferably from 2 to about 5 carbons (e.g., 2 carbons); and allyl containing at least 3 carbons, preferably from 3 to about 5 carbons (e.g., 3 carbons).

Representative example of suitable R and R' groups which can be associated together in an individual compound reprsented by structural formula [IX] include the following:

| R' | R |
|---|---|
| 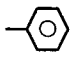 | —H |
| 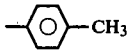 | —$CH_3$ |
| 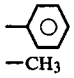 —$CH_3$ | —$CH_2$—$CH_3$ |
| | —C(—$CH_3$)$_2$—$CH_3$ |
| —$CH_2$—$CH_3$ | —$CH_2$—$OCH_3$ |
| —$CH_2$—$CH_2$—O—$CH_3$ | —$CH_2$—O— 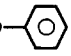 |
| —$CH_3$ | —$CH_2$—S— 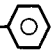 |
| | —O—$CH_3$ |
| 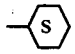 | —S—$CH_3$ |
| —$CH_2$— 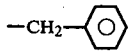 | 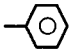 |
| 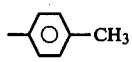 | —$CH_2$— 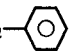 |
| —$CH_2$—$CH_2$—OH | |
| —$CH_3$ | —$CF_3$ |
| —$CH_2$—$CH_3$ | 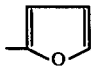 |
| —$CH_3$ | —$CH_3$ |
| —$CH_2$—CH=$CH_2$ | —$CH_3$ |
| —$CH_3$ | 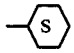 |

Other suitable diazonium salts include those represented by the structural formula:

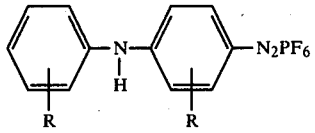

[X]

wherein R which may be the same or different is as defined in connection with structural formula IX.

The diazonium salts described by structural formula [IX] are particularly preferred because they possess a unique balance of properties when employed in a negative-working diazography formulation even in the absence of the sulfonamide additives described herein.

The particular advantages associated with this class of diazonium salts can best be described with reference to the properties of diazonium salts represented by structural formula [X] and those represented by the structural formula:

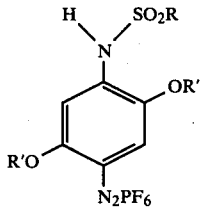

[XI]

wherein R and R' are as described above in connection with structural formula [IX]. Note that salts of structural formula [XI] are incompatible with the additives of structural formula [I] and are identified herein for purposes of illustration only.

For example when compounds of structural formula [XI] are employed in a negative-working diazography formulation the developing time necessary to achieve full density in the film image is substantial, e.g., about 50 seconds. Compounds of structural formula [X], however, require that the temperature-time ratio which governs the heating step during which unblocking of the blocked coupler occurs be adjusted to allow for either higher temperatures or longer heat exposure times (e.g., the film must make several passes e.g., about 5, through the heating zone) to achieve the desired results. The compounds of structural formula [IX], however, exhibit the most desirable balance between developing time and the temperature-time ratio during the heating step. Thus, the developing time of this class of compounds is about 1/5 as long as that of compounds described by structural formula [XI] and the heating time during unblocking of the coupler at a given temperature is about 1/5 as long as that of compounds described by structural formula [X]. In short the diazonium salts of structural formula [IX] achieve a higher maximum dye density (D-max) than those of either structural formulae [X] or [XI] for any given set of the aforenoted processing conditions.

Representative examples of suitable diazonium salts include those disclosed in commonly assigned U.S. Patent Application Ser. No. 66,401, filed on Aug. 14, 1979 the disclosure of which is herein incorporated by reference and include the following:

(1) O-Chlorobenzenediazonium hexafluorophosphate;

(2) p-N-Dimethylaminobenzenediazonium hexafluorophosphate;

(3) O-Methoxybenzenediazonium hexafluorophosphate;

(4) 2,4-Dimethoxybenzenediazonium hexafluorophosphate;

(5) 2,5-Diethoxy-4-[4'-chlorophenoxy]benzenediazonium hexafluorophosphate;

(6) 4-Benzyloxybenzenediazonium hexafluorophosphate;

(7) 2,5-Diethoxy-4-N-benzamidobenzenediazonium hexafluorophosphate;

(8)2-Methoxy-5-methyl-4-N-benzamidobenzenediazonium hexafluorophosphate;

(9) p-Ethoxybenzenediazonium hexafluorophosphate;

(10) 4-Chloronaphthalenediazonium hexafluorophosphate;

(11) p-Diazo-diphenylamine hexafluorophosphate;

(12) p-Diazo-3-methoxydiphenylamine hexafluorophosphate;

(13) p-Diazo-2,5-diethoxy-1-tolylmercaptobenzene diazonium hexafluorophosphate;

(14) 4-N-methanesufonamide-2,5 dimethoxybenzenediazonium hexafluorophosphate;

Other suitable and preferred diazonium hexafluorophosphate salts include those of the structural formulae:

| Chemical Structure | Chemical Name |
|---|---|
| 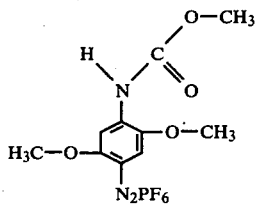 | 4-N-methoxycarbonylamino-2,5-dimethoxybenzenediazonium-hexafluorophosphate |
| 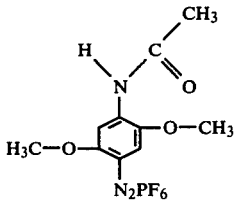 | 4-N-acetylamino-2,5-dimethoxybenzenediazonium-hexafluorophosphate |
| 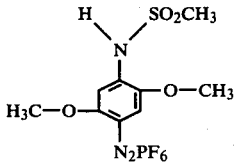 | 4-N-methylsulfonylamino-2,5-dimethoxybenzenediazonium-hexafluorophosphate |
| 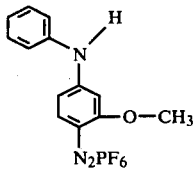 | 4-N-phenylamino-2-methoxybenzenediazonium-hexafluorophosphate |
| 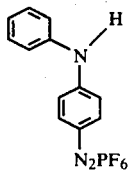 | 4-N-phenylamino-benzenediazonium-hexafluorophosphate |

-continued

| Chemical Structure | Chemical Name |
|---|---|
| 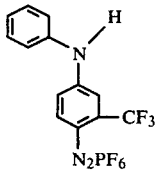 | 4-N-phenylamino-2-trifluoromethyl-benzenediazonium-hexafluorophosphate |
| 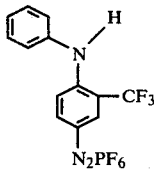 | 4-N-phenylamino-3-trifluoromethyl-benzenediazonium-hexafluorophosphate |
| 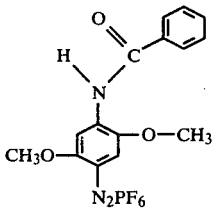 | 4-N-benzoyl-2,5-dimethoxy-benzenediazonium-hexafluorophosphate |
| 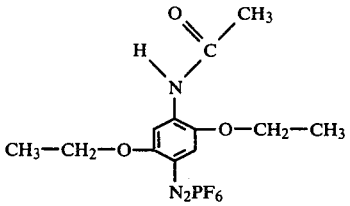 | 4-N-acetylamino-2,5-diethoxy-benzenediazonium-hexafluorophosphate |
| 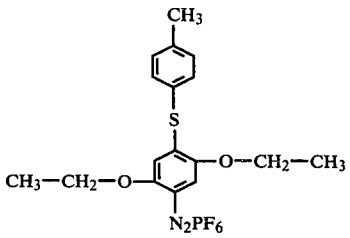 | p-diazo-2,5-diethoxy-1-tolylmercapto-benzenediazonium-hexafluorophosphate |

It will be appreciated that, while the coupler and diazonium salt molecules may bear any one or more substituents which will not interfere with the acid catalyzed unblocking chemistry, at least two sites must be available on the blocked-coupler for any rearrangement and for the subsequent coupling of the unblocked molecule to form azo dye.

The diazotype photoreproduction material according to the invention is conveniently produced by first preparing a solution in pure organic solvents of the two, essential components, i.e., a solution of the diazonium salt and blocked-coupler. The preferred solvents are low molecular weight ketones and alcohols because same, e.g., are typically good solvents for the hexafluorophosphate diazonium salts. In practice, it is of advantage to utilize a mixture of ketone and alcohol solvents. Also advantageously, the blocked-coupler is dissolved in the solvent solution with moderate mechanical stirring, then the diazonium salt is added and dissolved in a similar manner under subdued light, although the components may indeed be added in reverse order. The additive of structural formula [I] in the amount described herein as well as other desired additives (such as benzotriazole as described below) are then slowly stirred into the solution and the mix is filtered to remove insoluble particulates like dust.

In a preferred embodiment the diazography formulation additionally contains controlled effective amounts of certain additives as described in U.S. Patent Application Ser. No. 160,650, filed 1/18/80 by R. C. Desjarlais entitled "Negative-Working Diazo Type Photoreproduction Having Improved D-min and Line Acuity" the disclosure of which is herein incorporated by reference.

The additives described in this application can be represented by the structural formula:

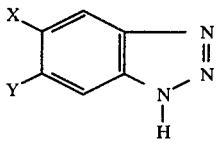

[XII]

wherein X and Y are selected from the group consisting of hydrogen, chlorine and methyl provided at least X or Y is hydrogen; and the structural formula:

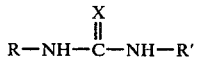

[XIII]

wherein R and R', which can be the same or different can be alkyl, preferably alkyl of from 1 to about 5 carbons; hydrogen; or together constitute a cyclic hydrocarbon group of from about 2 to about 8 carbons (e.g., 6 carbons); and X is oxygen or sulfur.

Representative examples of suitable additives which correspond to the structural formulae [XII] and [XIII] include benzotriazole; 5-methylbenzotriazole; 6-methylbenzotriazole; urea; thiourea; dibutylurea; dibutylthiourea; dimethylurea; dimethylthiourea and the like.

The most preferred additive is benzotriazole.

The effective amounts of said additives will generally constitute a molar ratio of additive, e.g., benzotriazole, to diazonium salt of from about 1:20 to about 1:100, preferably from about 1:30 to about 1:80, and most preferably from about 1:40 to about 1:75 respectively.

The controlled amounts of said additives provide an acid scavenging effect during and after the imaging step. The additional presence of said additives in the formulation improves (i.e., reduces) the D-min of the resulting image and also improves the image line acuity derived from the described formulations.

While the amounts of the respective components formulated are not especially critical, it has been determined that incorporation of the diazonium salt in amounts of up to 7 parts by weight per 100 g of total mix is eminently practicable, preferably not less than 0.5 parts by weight of total mix. The blocked-coupler can be incorporated in an amount sufficient to achieve a molar ratio thereof to the diazonium salt, of from about 0.1:1 to about 2:1 and preferably from about 0.8:1 to about 1.2:1 (e.g., 1:1) respectively.

In a preferred embodiment of the invention, the mix contains a quantity of approximately 1.0 mole of blocked-coupler per approximately 1.0 mole of diazonium salt.

Conveniently, the immediately aforesaid mix is applied to any suitable base substrate, e.g., cellulose acetate butyrate, cellulose acetate propionate, ethyl cellulose, silica/polyvinylbutyral, polyvinyl acetate, and preferably to coatings of the aforementioned materials borne by a transparent or opaque polyethylene terephthalate (polyester) film base, by imbibition or bead coating such that approximately 30 grams of mix are laid down per square yard. This consumption varies according to the specific components utilized, the type and thickness of the polymer prcoating, and the image density desired. Preferably, the subbed base is overcoated with a layer of cellulose ester, ether, or the like; or the coating can itself comprise a like matrix resin in addition to the solution of the imaging chemicals. A representative film prepared according to the invention would comprise a 0.92–7 mil bond coated polyester base, overcoated with, e.g., a 0.25 mil matrix resin (for example, cellulose acetate propionate) overcoating including the imaging chemicals. Other suitable substrates include the conventional diazo paper bases, textile substrates, nonwovens, etc. See generally the U.S. Pat. No. 3,976,491 to Desjarlais.

While the imaging components may all be coated in a single layer, a coating of this type may employ two or more diazonium salts to improve photo-speed, and/or color, or it may contain more than a single blocked-coupler.

The resulting film is then imaged with the appropriate light source, preferably heated as described herein to assure unblocking of the coupler by acid cleavage, the image developed (i.e., the unblocked coupler and unreacted diazonium salt are reacted) in the light struck areas by exposure to a typical alkaline developing environment, e.g., moist ammonia and the film cleared as described herein.

The invention is additionally illustrated in connection with the following Examples which are to be considered as illustrative of the present invention. It should be understood, however, that the invention is not limited to the specific details of the Examples.

EXAMPLE 1

A light-sensitive coating formulation comprising the following components was prepared:

| COMPONENT | AMOUNT (gms) | AMOUNT (moles) |
|---|---|---|
| Acetone | 100 | |
| 95% t-butyl-1-naphthyl ether (mw 200) | 2.15 | .01 |
| 4-N-Methoxycarbonylamino-2,5-dimethoxy benzenediazoniumhexafluorophosphate (mw 383) | 3.83 | .01 |
| p-Toluenesulfonylbenzamide (mw 274) | 1.98 | .0072 |

The acetone is used to dissolve the ether, then the diazonium salt is stirred into the solution. All operations are carried out in subdued light.

The solution is then applied to 7 mil, cellulose acetate propionate (CAP) precoated polyethylene terephthalate (polyester) using a bead coating technique and the resultant film dried in an oven.

The material is used in the following manner: Imagewise exposure of duplicate film samples is made with a Stauffer #AT20x0.15 photograhic step tablet in a Scott 716 TM microprinter equipped with a gallium doped mercury vapor lamp for 13 seconds.

Each film sample is then heated to a temperature of 190° F. in a Scott SG 24 TM preheater for 10 seconds and then passed through an ammonia rich atmosphere using a Teenifax 6000 developer which is set to feed a 22% by weight ammonium hydroxide aqueous solution at the rate of 1.0 cc/min to a hot plate whereby ammonia gas and water vapor are delivered to the film surface. The developed film is then cleared of residual diazo from the back of the film by exposure to actinic light for 60 seconds using the Scott 716 TM microprinter.

Density measurements at 3600A° using a MacBeth Quanta Log Densitometer are conducted on the image obtained. The results are summarized at Table I, run 2.

To provide a control, the above procedure is repeated with the exception that the toluenesulfonylbenzamide is omitted from the diazography formulation used to prepare the film sample.

The color of each film sample is observed and the results summarized at Table I.

One of the above described film samples and one control sample are then aged at room temperature by exposing them to UV light for 3.5 hrs using the Scott 716 TM microprinter.

Each film sample is observed for the appearance of bloom and the results summarized at Table I. The bloom, which is believed to consist of ammonium dihydrogen phosphate, is manifested by the appearance of a frosting on the film surface as opposed to a clear transparent colorless appearance in the D-min areas of the film.

EXAMPLE 2

Example 1 is repeated with the exception that 0.035 g. (0.00029 moles) of benzotriazole are added in addition to the p-toluenesulfonylbenzamide to improve the line acuity of the image. The results are summarized at Table I run 3.

As can be seen from the data of Table I, the p-toluenesulfonylbenzamide substantially eliminates the acid discoloration which is manifested in the control by a blue-black color. The azo dye formed is characterized by a sepia color which is preserved by the p-toluenesulfonylbenzamide. The bloom of ammonium dihydrogen phosphate is also substantially eliminated as manifested by the lack of frosted appearance in D-min areas of the film when compared to the control.

The presence of the benzotriazole substantially improves line acuity. Thus, the combination of the benzotriazole and p-toluenesulfonylbenzamide results in a color stable, low bloom, and high line acuity film.

TABLE I

| RUN NO. | FILM SAMPLE SOURCE EXAMPLE NO. | ADDITIVE | D-max | D-min | VISUAL OBSERVATIONS COLOR | BLOOM AFTER AGING | LINE ACUITY |
|---|---|---|---|---|---|---|---|
| 1 | 1 (control) | none | 2.37 | .55 | Blue-black | D-min areas turn distinctly frosted in appearance | Poor |

TABLE I-continued

| RUN NO. | FILM SAMPLE SOURCE EXAMPLE NO. | ADDITIVE | D-max | D-min | VISUAL OBSERVATIONS COLOR | BLOOM AFTER AGING | LINE ACUITY |
|---|---|---|---|---|---|---|---|
| 2 | 1 | p-toluene-sulfonyl benzamide | 2.22 | .34 | Sepia | D-min areas remain clear | Poor |
| 3 | 2 | p-toluene-sulfonyl benzamide + benzotri-azole | 1.99 | .32 | Sepia | D-min areas remain clear | Very good |

EXAMPLE 3

A diazography formulation is prepared generally in accordance with the procedures of Example 1 using the following components:

| COMPONENT | AMOUNT Grams | Moles |
|---|---|---|
| 90% t-butyl-1-naphthyl ether | .4 | .018 |
| benzotriazole | .07 | .00059 |
| 4-N-acetylamino-2,5-dimethoxy benzenediazoniumhexafluorophosphate | 6.92 | .018 |
| Acetone | 100 | |

The mix is divided into equal portions and to one of the portions is added 1.92 g (0.009 moles) of p-toluenesulfonylacetamide (i.e., run 1) and the other sample serves as a control (i.e., run 2).

Each of the mixes is bead coated onto a polyester film which had been previously coated with a layer of cellulose acetate propionate and dried. The films are then exposed in a Scott 716 TM microprinter with a Kodak TM #2 photographic step tablet as a master for 10 seconds. The films are then heated in a Scott 24 TM preheater to a temperature of 190° F. for 8 seconds and developed in a Scott TM model 6000 developer which is set to feed a 22% by weight ammoniumhydroxide solution at the rate of 1.0 cc/min to a hot plate whereby ammonia gas and water vapor are delivered to the film surface. The films are cleared of residual diazo from the back of the film by exposure for 60 seconds to actinic light from the Scott716 TM microprinter employed in the imaging step equipped with a gallium doped mercury vapor lamp.

The film samples are then visually observed immediately and after aging at room temperature for one week and one month for discoloration, and after one week and one month of aging for bloom. The results are summarized at Table II.

As may be seen from Table II the control exhibits a blue-black appearance which is known to be the acidified form of the azo dye. The intended color which results from development with ammonium is sepia which color is exhibited by the film sample employing the p-toluenesulfonylacetamide.

Furthermore, the film sample of run 1 exhibits a substantial reduction in bloom as opposed to the control which blooms heavily as is readily apparent by the loss of transparency in the D-min areas of the film sample of run 2.

TABLE II

| RUN NO. | IMAGE COLOR IMMEDIATELY AFTER CLEARING | ONE WEEK AFTER CLEARING | ONE MONTH AFTER CLEARING | BLOOM AFTER ONE WEEK | AFTER ONE MONTH |
|---|---|---|---|---|---|
| 1 | Sepia | Sepia | Sepia | None-clear film in D-min areas of the film | None-clear film in D-min areas of the film |
| 2 (control) | Blue-black | Purple | Reddish-purple | Heavy loss of transparency in D-min areas of the film* | Heavy loss of transparency in D-min areas of the film* |

*Bloom analyzed to be ammonium dihydrogen phosphate by I.R. Spectroscopy.

EXAMPLE 4

A diazography formulation containing the following components is prepared in accordance with the procedures of Example 1.

| COMPONENT | AMOUNT (parts by weight) |
|---|---|
| 4-N-acetylamino-2,5-dimethoxy-benzenediazoniumhexafluorophosphate | 3.28 |
| 4-N-methoxycarbonylamino-2,5-dimethoxy-benzenediazoniumhexafluorophosphate | .38 |
| benzotriazole | .020 |
| t-butyl-1-naphthylether | 2.22 |
| 2-(morpholinosulfonyl)-1-(methoxyethoxymethyl)-naphthylether | 0.4 |
| p-toluenesulfonylbenzamide | 1.60 |
| Acetone | 50.0 |

When the formulation is applied to a film substrate in accordance with the procedures of Example 1 results similar to those achieved in Example 3 are obtained.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A light-sensitive diazography formulation comprising (1) at least one light-sensitive hexafluorophosphate salt of a diazonium compound adapted to photolytically cleave into an acid catalyst; (ii) at least one acid labile arylenolic blocked-coupler adapted to be converted in the presence of acid to an active azo-coupling species; and (iii) an effective amount of at least one additive represented by the structural formula:

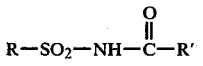

wherein R is selected from the group consisting of aryl of from about 6 to about 10 carbons, alkyl of from about 1 to about 12 carbons, aralkyl wherein aryl is from 6 to about 10 carbons and the alkyl is from about 1 to about 5 carbons, R' is selected from the group consisting of hydrogen, alkyl of from about 1 to about 12 carbons, aryl of from 6 to about 10 carbons, alkoxy of from about 1 to about 12 carbons, alkylthiomethyl of from about 1 to about 5 carbons, alkoxymethyl wherein the alkyl group contains from about 1 to about 5 carbons, trifluoroalkyl of from about 1 to about 3 carbons, aralkyl wherein the aryl thereof has from 6 to about 10 carbons and the alkyl thereof contains from about 1 to about 5 carbons, amino, and alkyl substituted amino of from about 1 to about 5 carbons, said effective amount being sufficient to reduce acid discoloration and bloom.

2. A light-sensitive diazography formulation comprising (i) at least one light-sensitive hexafluorophosphate salt of a diazonium compound adapted to photolytically cleave into an acid catalyst; (ii) at least one acid labile enolic blocked-coupler adapted to be converted in the presence of acid to an active azo-coupling species; and (iii) an effective amount of at least one additive represented by the structural formula:

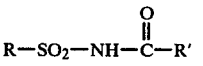

wherein R is selected from the group consisting of aryl of from about 6 to about 10 carbons, alkyl of from about 1 to about 12 carbons, aralkyl wherein aryl is from 6 to about 10 carbons and the alkyl is from about 1 to about 5 carbons, R' is selected from the group consisting of hydrogen, alkyl of from about 1 to about 12 carbons, aryl of from 6 to about 10 carbons, alkoxy of from about 1 to about 12 carbons, alkylthiomethyl of from about 1 to about 5 carbons, alkoxymethyl wherein the alkyl group contains from about 1 to about 5 carbons, trifluoroalkyl of from about 1 to about 3 carbons, aralkyl wherein the aryl thereof has from 6 to about 10 carbons and the alkyl thereof has from about 1 to about 5 carbons, amino, and alkyl substituted amino of from about 1 to about 5 carbons, said effective amount being sufficient to reduce acid discoloration and bloom.

3. The diazography formulation of claim 1 wherein said additive is present therein in an amount sufficient to achieve a molar ratio thereof to the diazonium salt of from about 2:1 to about 1:2.

4. The diazography formulation of claim 1 wherein the additive is selected from at least one member of the group consisting of p-toluenesulfonylacetamide; p-toluenesulfonylformamide; p-toluenesulfonylbenzamide; p-toluenesulfonylpivalamide; p-toluenesulfonyltrifluoroacetamide; p-toluenesulfonylmethylcarbamate; p-toluenesulfonylphenylacetamide; p-toluenesulfonylurea; and methanesulfonylacetamide.

5. The diazography formulation of claim 1 wherein said acid labile blocked-coupler has the structural formula:

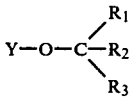

wherein each R, which may be the same or different, is selected from the group consisting of alkyl, aryl, cycloalkyl, aralkyl, and alkaryl, and Y is aryl.

6. The diazography formulaton of claim 5 wherein each R is selected from the group consisting of alkyl and aryl.

7. The diazography formulation of claim 1 wherein said acid labile blocked-coupler has the structural formula:

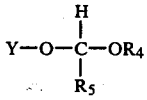

wherein $R_4$ and $R_5$, which may be the same or different, are selected from the group consisting of alkyl, aryl, cycloalkyl, aralkyl, and alkaryl, $R_5$ may also be hydrogen, and Y is aryl.

8. The diazography formulation of claim 7 wherein $R_4$ and $R_5$ are selected from the group consisting of alkyl and aryl.

9. The diazography formulation of claim 1 wherein said acid labile blocked-coupler has the structural formula:

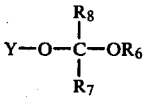

wherein $R_6$, $R_7$ and $R_8$, which may be the same or different, are selected from the group consisting of alkyl, aryl, cycloalkyl, aralkyl, alkaryl, and Y is aryl.

10. The diazography formulation of claim 9 wherein $R_6$, $R_7$ and $R_8$ are selected from the group consisting of alkyl and aryl.

11. The diazography formulation of claim 1 wherein said acid labile phenolic blocked-coupler has the structural formula:

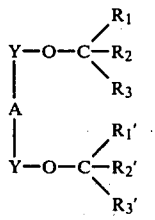

wherein each $R_1$, $R_2$ and $R_3$, which may be the same or different, is selected from the group consisting of alkyl, aryl, cycloalkyl, aralkyl, and alkaryl, Y is aryl, and A is any bridging linkage.

12. The diazography formulation of claim 11 wherein each $R_1$, $R_2$ and $R_3$ is selected from the group consisting of alkyl and aryl.

13. The diazography formulation of claim 1 wherein said acid labile blocked-coupler has the structural formula:

$$Y—O—CH_2—O—CH_2CH_2—OCH_3$$

wherein Y is aryl.

14. The diazography formulation of claim 1 wherein said acid labile blocked-coupler has the structural formula:

$$\begin{array}{l} Y—O—CH_2—O—CH_2—CH_2—O—CH_3 \\ | \\ A \\ | \\ Y—O—CH_2—O—CH_2—CH_2—O—CH_3 \end{array}$$

wherein Y is aryl and A is any bridging linkage.

15. The diazography formulation of claim 1 wherein said acid labile blocked-coupler has the structural formula:

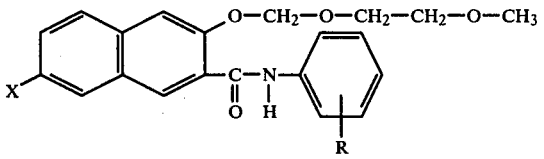

wherein X is selected from the group consisting of hydrogen, bromine, and methoxy, R is selected from the group consisting of alkyl of from about 1 to about 8 carbons, alkoxy of from about 1 to about 8 carbons, acyl, and halogen.

16. The diazography formulation of claim 1 wherein said acid labile blocked-coupler is selected from the group consisting of 1-naphthyltriphenyl-methyl ether; 1-butoxy-1-(1-naphthoxy)ethane; t-butyl phenylether; 2-(1-naphthoxy)-3-methyl-butane; 1-(1-butoxy)-1(1-naphthoxy)ethane; dibenzo(d,f)-2,2-dimethyl-1,3-dioxepine; dibenzo(d,f)-2-methyl-2-phenyl-1,3-dioxepine; dibenzo(d,f)-2,2-diphenyl-1,3-dioxepine; 2,2'-di(2-tetrahydropyranoxy)diphenyl; 2,3-isopropylidenedioxynaphthalene; t-butyl-1-naphthyl ether; 1-naphthyl-2-tetrahydropyranyl ether; benzo(e)-2-phenyl-1,3-dioxin; t-butyl-(4-bromo-1-naphthyl) ether; dibenzo(d,f)-2-methyl-1,3-dioxepine; $\beta$-methoxyethoxymethyl-$\alpha$-naphthylether; 3-(methoxyethoxymethoxy)-N-(2-ethylphenyl)-2-naphthalamide; 2-(morpholinosulfonyl)-1-(methoxyethoxymethyl)-naphthyl ether; 3-benzyloxy-2-(methoxyethoxymethyl)naphthyl ether; Bis(3-methoxyethoxymethoxy-1-phenylene)ethylene diether; 8-N-benzoylamino-2-(methoxyethoxymethyl)naphthyl ether; 2,2'-methoxyethoxymethoxy biphenyl; 2-(morpholinocarbonyl)-1-(methoxyethoxymethyl)-naphthyl ether; 5-N-acetylamino-3-(methoxyethoxymethyl)-naphthyl ether; 1,2-Bis(2,2'-methoxyethoxymethoxyphenyl)-cyclopropane; 8-N-acetylamino-2(methoxyethoxymethoxy)naphthyl ether; 3-(2-hydroxyethoxy)-2-(methoxyethoxymethyl)-naphthyl ether.

17. The diazography formulation of claim 1 wherein said acid labile blocked-coupler is t-butyl-1-naphthyl ether.

18. The diazography formulation of claim 1 wherein the light sensitive hexafluorophosphate salt of said diazonium compound is illustrated by the structural formula:

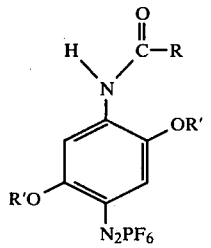

wherein R can represent hydrogen; alkyl of from 1 to about 10 carbons; aryl of from 6 to 10 carbons; cycloalkyl of from 3 to about 6 carbons; aralkyl and alkaryl wherein the alkyl and aryl groups thereof are as described above; alkoxy of from about 1 to about 5 carbons; alkylthio of from about 1 to about 5 carbons; alkoxymethyl wherein the alkyl group thereof has from about 1 to about 5 carbons; aryloxymethyl and arylthiomethyl wherein the aryl groups thereof are as defined above, trifluoroalkyl wherein the alkyl group thereof is as defined above; and furanyl; and R', which can be the same or different can represent alkyl, aryl, cycloalkyl and aralkyl as defined above in connection with R with the proviso that R' cannot be tertbutyl; hydroxyalkyl wherein the alkyl group contains from 2 to about 5 carbons; methoxyalkyl wherein the alkyl group contains from 2 to about 5 carbons; and allyl of from about 3 to about 5 carbons.

19. The diazography formulation of claim 18 wherein said diazonium salt is selected from the group consisting of 4-N-methoxycarbonylamino-2,5-dimethoxy-benzenediazoniumhexafluorophosphate; and 4-N-acetylamino-2,5-dimethoxybenzenediazoniumhexafluorophosphate.

20. The diazography formulation of claim 18 wherein the diazonium salt is 4-N-acetylamino-2,5-dimethoxybenzenediazoniumhexafluorophosphate.

21. The diazography formulation of any one of claims 1 to 20 which additionally comprises at least one compound selected from the group represented by the structural formula:

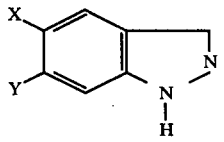

wherein X and Y are selected from the group consisting of hydrogen, chlorine and methyl provided at least X or Y is hydrogen; and the structural formula:

$$R—NH—\overset{\overset{X}{\|}}{C}—NH—R'$$

wherein R and R', which can be the same or different are selected from the group consisting of alkyl of from 1 to about 5 carbons; hydrogen; or together constitute a cyclic hydrocarbon group of from about 3 to about 8 carbons; and X is selected from the group consisting of oxygen and sulfur, said additive being present in an amount sufficient to achieve a molar ratio thereof to the diazonium salt of from about 1:20 to about 1:100.

22. The diazography formulation of claim 1 wherein the blocked-coupler is a mixture of t-butyl-naphthyl ether and 2-(morpholino sulfonyl)-1-(methoxyethoxymethyl)naphthyl ether, the additive is p-toluenesulfonylbenzamide, and additionally comprises benzotriazole in an amount sufficient to achieve a molar ratio thereof to the diazonium salt of from about 1:20 to about 1:100.

23. A light-sensitive diazotype photoreproduction material, comprising a support member coated with the diazography formulation as defined by any of claims 1, 2, 18, and 22.

24. The light-sensitive diazotype photoreproduction material of claim 23 comprising a support member which is a film substrate.

25. The photoreproduction material as defined by claim 24, said diazography formulation including a resin matrix.

26. A negative-working diazography photoreproduction process, comprising imagewise exposing the diazotype material as defined by claim 23 to light of a quality and quantity sufficient to photochemically liberate catalytic amounts of acid therefrom, thus unblocking coupler molecules, developing said diazotype material under alkaline conditions such that active azo-coupling species couple with undecomposed diazonium compound in the light-struck areas to form azo dye, and thence decomposing the unreacted diazonium salt by exposure to actinic light.

* * * * *

UNITED STATES PATENT AND TRADEMARK OFFICE

CERTIFICATE OF CORRECTION

PATENT NO. : 4,307,170

DATED : December 22, 1981

INVENTOR(S) : Robert C. Desjarlais

It is certified that error appears in the above-identified patent and that said Letters Patent are hereby corrected as shown below:

Col. 4, line 45, correct "threby" to read

--thereby--,

Claim 21, Col. 30, line 50 correct

" 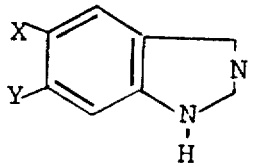 "

to read

-- 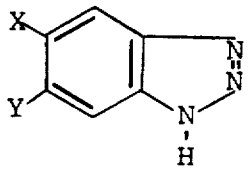 --.

Signed and Sealed this

Twenty-seventh Day of July 1982

[SEAL]

Attest:

GERALD J. MOSSINGHOFF

Attesting Officer

Commissioner of Patents and Trademarks